US005458501A

United States Patent [19]

Lazaro, Jr. et al.

[11] Patent Number: 5,458,501

[45] Date of Patent: Oct. 17, 1995

[54] BAYONET COUPLING CABLE CLAMP

[75] Inventors: Luis J. Lazaro, Jr., Seattle; Franklin D. Harsch, Renton, both of Wash.

[73] Assignee: The Boeing Company, Seattle, Wash.

[21] Appl. No.: 48,702

[22] Filed: Apr. 15, 1993

Related U.S. Application Data

[63] Continuation-in-part of Ser. No. 901,468, Jun. 19, 1992, abandoned, which is a continuation-in-part of Ser. No. 827,118, Jan. 28, 1992, abandoned, which is a continuation-in-part of Ser. No. 660,313, Feb. 22, 1991, abandoned, which is a continuation-in-part of Ser. No. 516,403, Apr. 30, 1990, abandoned.

[51] Int. Cl.[6] ..... H01R 4/54

[52] U.S. Cl. ..... 439/318; 439/472; 439/609

[58] Field of Search ..... 439/314, 315, 439/318, 319, 460, 464, 470, 472, 473, 320, 321, 609, 610, 905

[56] References Cited

U.S. PATENT DOCUMENTS

| | | | |
|---|---|---|---|
| 2,005,475 | 6/1935 | Schmidt | 439/319 |
| 2,984,811 | 5/1961 | Hennessey, Jr. et al. | 439/153 |
| 3,478,302 | 11/1969 | Chirumbolo | 439/314 |
| 3,750,087 | 7/1973 | Vetter | 439/318 |
| 3,901,574 | 8/1975 | Paullus et al. | 439/315 |
| 4,213,664 | 7/1980 | McClenan | 439/472 |
| 4,509,814 | 4/1985 | Mattingly, Jr. | 439/314 X |
| 4,534,607 | 8/1985 | Tomsa | 439/312 |
| 4,629,272 | 12/1986 | Mattingly et al. | 439/318 |
| 4,676,573 | 6/1987 | Norman | 439/321 |
| 4,737,119 | 4/1988 | Stieler | 439/318 |
| 4,808,123 | 2/1989 | Dee et al. | 439/470 |
| 4,869,687 | 9/1989 | Johnson | 439/470 |
| 4,900,260 | 2/1990 | Drogo | 439/321 |
| 4,925,404 | 5/1990 | Dutcher | 439/610 |
| 5,082,454 | 1/1992 | Tonkiss et al. | 439/320 |
| 5,123,860 | 6/1992 | Kamei et al. | 439/610 X |
| 5,205,547 | 4/1993 | Mattingly | 439/318 X |

FOREIGN PATENT DOCUMENTS

| | | | |
|---|---|---|---|
| 0080930 | 6/1983 | European Pat. Off. | 439/320 |
| 2002273 | 10/1969 | France | 439/314 |
| 1138364 | 1/1969 | United Kingdom | 439/318 |
| 2023358 | 12/1979 | United Kingdom | 439/314 |

*Primary Examiner*—Khiem Nguyen
*Attorney, Agent, or Firm*—Conrad O. Gardner; B. A. Donohue

[57] ABSTRACT

A cable clamp which utilizes a bayonet coupling attachment mechanism when coupled into an electrical connector. Attachment means of the cable clamp may utilize one of the two designs for two airplane general environments, such as the pressurized and unpressurized high vibration areas. Helical ramp grooves formed in the interior of a coupling ring act against bayonet pins mounted on a connector to effect coupling between the two components. A preloaded wavespring washer becomes effective during coupling of a Single Leg cable clamp used in the pressurized area, while a specially tapered spring washers become effective during the coupling procedure to maintain a no-motion condition on a Saddle-type cable clamp used in unpressurized, high vibration areas. Additionally, a plurality of detent pins are automatically shifted into a holding position at the completion of the coupling action, thereby further contributing to the maintenance of the coupled condition between the Saddle-type cable clamp and connector. Also, a grounding spring is centrally positioned on the cable clamp body which when coupled to an electrical connector makes interengageable contact thus providing low impedance and additional mechanical strengthening properties to the cable clamp.

10 Claims, 4 Drawing Sheets

BAYONET COUPLING CABLE CLAMP

CROSS REFERENCE TO RELATED APPLICATIONS

This is a continuation-in-part of application Ser. No. 07/901,468 filed in Jun. 19, 1992 now abandoned, which is a continuation-in-part of application Ser. No. 07/827,118 filed in Jan. 28, 1992 now abandoned, which is a continuation-in-part of application Ser. No. 660,313 (now abandoned) filed in Feb. 22, 1991, which is a continuation-in-part of Ser. No. 516,403 (now abandoned) filed Apr. 30, 1990.

BACKGROUND OF THE INVENTION

This invention relates to cable clamps used on electrical connectors, and more particularly to a bayonet coupling cable clamp suitable for attachment to an electrical circular connector.

Past efforts for assembling a connector with cable clamp have included the following requirements:

1) Clean thread surfaces of cable clamp with cleaning solvent and wipe dry with absorbent wiper. Apply two drops of thread locking compound, each covering a minimum of two threads approximately 180 degrees apart, to the external threads of all parts prior to assembly of the connector and cable clamp. Allow compound to dry before assembly.

2) Tighten the cable clamp by hand, then tighten slightly beyond hand tight (maximum of ⅛ turn) with tools such as strap wrench, plug plier, others.

OR

Torque and lockwired cable clamp per engineering drawing.

The above assembly process results in the following problems encountered by manufacturing:

1) Loose cable clamp due to coupling inconsistency caused by:
   operator
   tool usage
   incorrect torque value 2) Process is laborious and too operator dependent.

3) Torque tools and accessories are expensive.

4) High reword and maintenance cost.

5) Cable clamp assembly is not conducive to automation or robotic manipulation;

In contrast to the present connector which utilizes a rotating bayonet attachment, prior art patent literature has included:

Vetter U.S. Pat. No. 3,750,087 which describes a preloaded connector which utilizes specially configured spring washers to maintain the connector halves in their coupled condition, but such connector uses a threaded cable clamp; and Chirumbolo U.S. Pat. No. 3,478,302; Hennessey, et al. U.S. Pat. No. 2,984,811; and Paullus, et al. U.S. Pat. No. 3,901,574, which includes a rotating bayonet action for assembling the connector, however, not including cable clamps as hereinafter described.

SUMMARY OF THE INVENTION

Accordingly, one object of the present invention is to provide a preloaded connector cable clamp in which the relative motion between the cable clamp's components is essentially eliminated. In this regard, an aim of the invention is to provide a cable clamp in which there is a metal-to-metal bottoming of components when installed into an electrical connector to function as a wire bundle strain relief clamp and provide grounding path between cable clamp and connector. It will be appreciated that once the cable clamp is installed into an electrical connector, that they should not become inadvertently uncoupled, yet the cable clamp should allow ready uncoupling when it is desired to separate the cable clamp from the connector. Consequently, it is within the purview of the present invention to provide a cable clamp that will withstand a high degree of vibration, large shock forces, and appreciable temperature gradients or changes. Also, it is within the contemplation of the invention to provide a cable clamp that will be long lasting and exceedingly reliable during the entire assembly life.

Another object of the invention is to provide a cable clamp that requires relatively easy manual force to effect the coupling thereof. In this regard, the helical ramp grooves are configured so that most of the mating travel occurs before any appreciable amount of spring deflection occurs.

Yet another object of the invention is to provide a set of detent balls that automatically become effective in keeping the spring washers in place in maintaining the cable clamp in its coupled condition, the detent balls being shifted into their latching condition near the end of the rotation of the coupling ring. More specifically, the load on the specially designed spring washers can be predetermined within desired limits, a retainer ring being positioned and secured in place to thereafter provide the correct amount of spring loading subsequent use of the cable clamp.

A further object of the present invention is to provide a preloaded cable clamp in which the coupling and uncoupling mechanism is effected without the use of tools. In this regard, it is within the purview of the invention to effect exceedingly reliable coupling less attributes such as torque threshold value, defective torque tools, deficient cable clamp assembly, and labor intensive safety wires (lockwiring).

Yet another object of the invention is to provide a cable clamp having a low impedance property achieved through the use of a grounding spring. In this regard, a ground path from the cable clamp to the electrical connector that exist when the two components are coupled together. The mode or state of the aircraft, whether static or dynamic, is of no consequence to the integrity and reliability on the electrical interface between cable clamp and connector.

It is a further object of this invention to provide a cable clamp conducive to robotic and automated assembly into an electrical connector, as evidenced by the easy rotation on the coupling ring of the cable clamp to be used as the interface surface between cable clamp and connector. More specifically, an aim of the invention is to provide a means by which the assembly occurs when the helical ramp grooves formed in the interior of a coupling ring act against a plurality of bayonet pins mounted on an electrical connector.

DESCRIPTION OF THE PREFERRED EMBODIMENT OF THE PRESENT INVENTION

The preferred embodiment of the present invention utilizes attachment to an electrical connector by a bayonet coupling method. Such preferred embodiment can replace the conventional threaded coupling arrangement that is presently used to assemble the cable clamp into an electrical connector. The coupling method described herein comprises a spring washer having a tapered cross section that is progressively deflected, reaching a desired state of compression near the end of the coupling action. The requisite deflection occurs after a metal-to-metal bottoming on the cable clamp components with respect to an electrical connector has been achieved. A plurality of bayonet pins and correspondingly spaced helical ramp grooves arrangement are used in effecting the coupling between the cable clamp and electrical connector. Provision is also made for maintaining the action provided by the flexed spring washers, a plurality of detent balls being automatically shifted into an interfering relationship so that they supplement the retentive actions of the spring washers.

DETAILED DESCRIPTION OF THE INVENTION

Figures 1, 2:
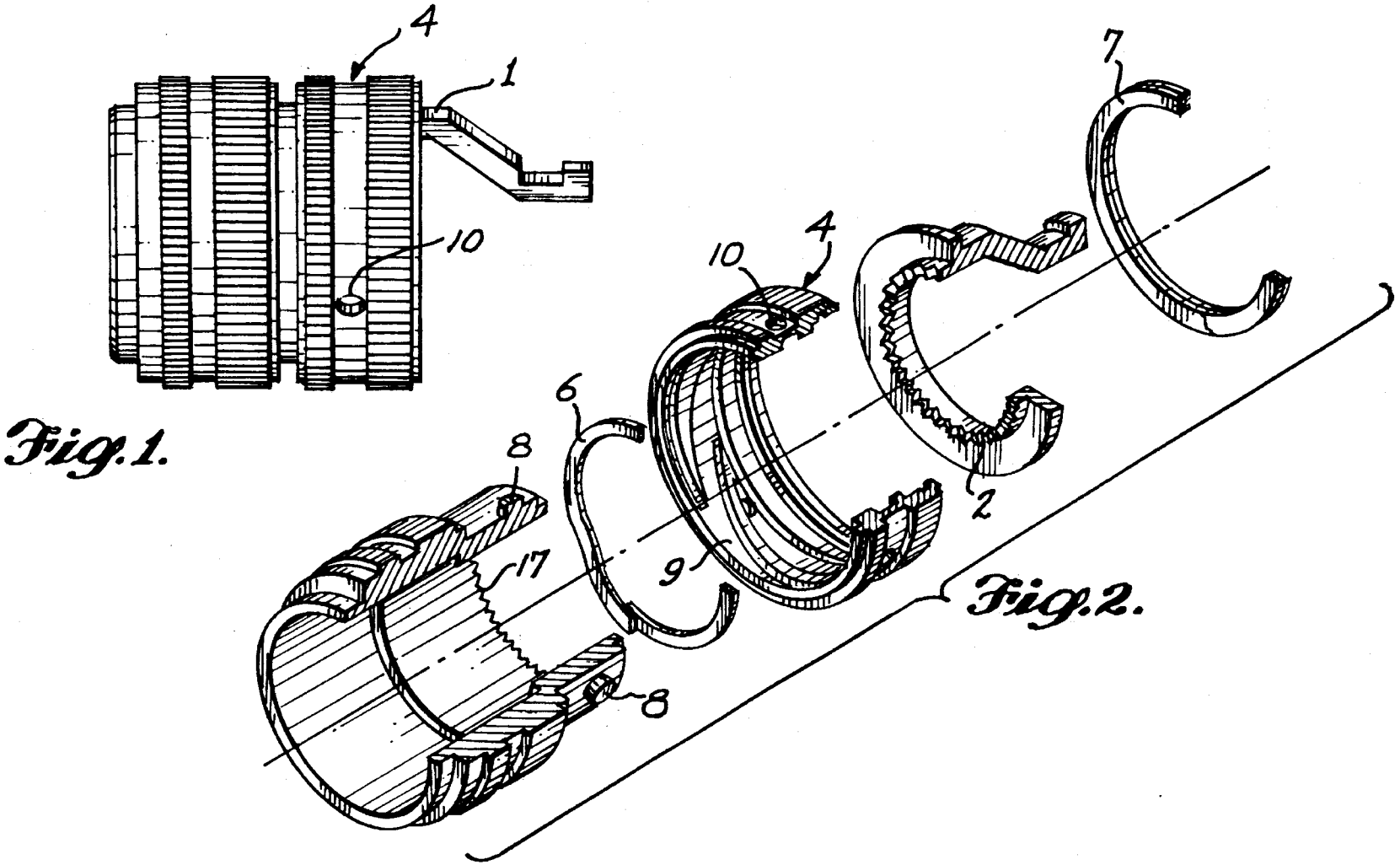
FIG. 1 is a side elevation of a single-leg cable clamp coupled to an electrical connector wherein coupling is accomplished by a bayonet mechanism whereby bayonet pins 8 are nested on the detent holes 10 of the cable clamp coupling ring 4.
FIG. 2 is an exploded view of FIG. 1 which shows in detail the components of the cable clamp, such as the wavespring washer 6, coupling ring 4 with helical ramp grooves 9 in a spaced relationship formed in the interior of coupling ring 4, clamp body 1 having accessory teeth 2 per MS 3155, and retaining ring 7 connecting coupling ring 4 to the clamp body 1. Also shown are the bayonet pins 8 mounted in an electrical connector that are correspondingly positioned with the helical ramp grooves 9 on the coupling ring 4 and mating accessory teeth 17 on the connector.
Figure 3:
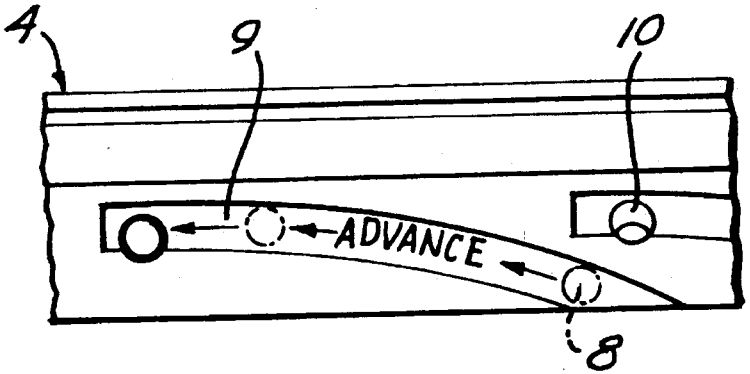
FIG. 3 is a plan view of the coupling ring 4 illustrating connector bayonet pin 8 traversing one of the ramp groove 9 on a single-leg type cable clamp; the rightmost phantom outline of one of the bayonet pins 8 showing the entering of the bayonet pins 8 into the ramp groove 9 and the other phantom position illustrating the point in the bayonet travel where the wavespring washer 6 starts to become compressed, and the solid or leftmost position of the bayonet pin 8 nested in the detent hole 10 on the coupling ring 4 is illustrating fully coupled condition of the cable clamp at which point the wavespring washer 6 has become sufficiently deflected to assure retentive coupled condition.
Figure 4:
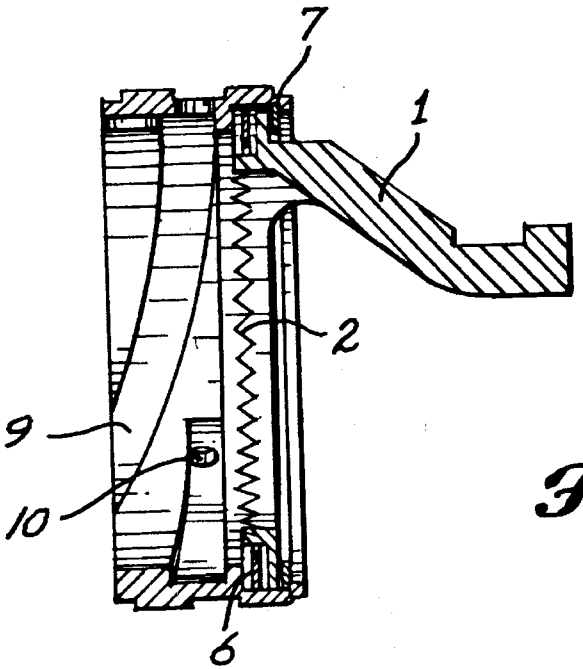
FIG. 4 is a cross-sectional isometric view of a single-leg cable clamp.
Figure 8:
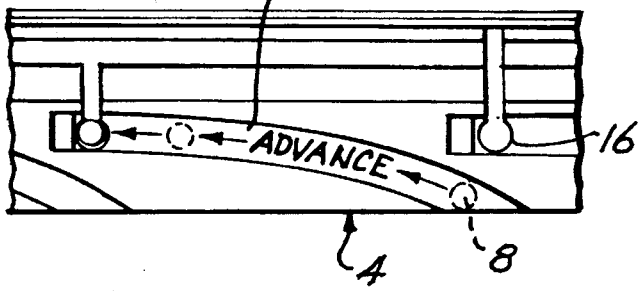
FIG. 8 is the same as FIG. 3 except that the illustration is for a saddle-type cable clamp. More specifically, spring washers 11 are deflected to achieve MMB 5 condition.
Figure 6:
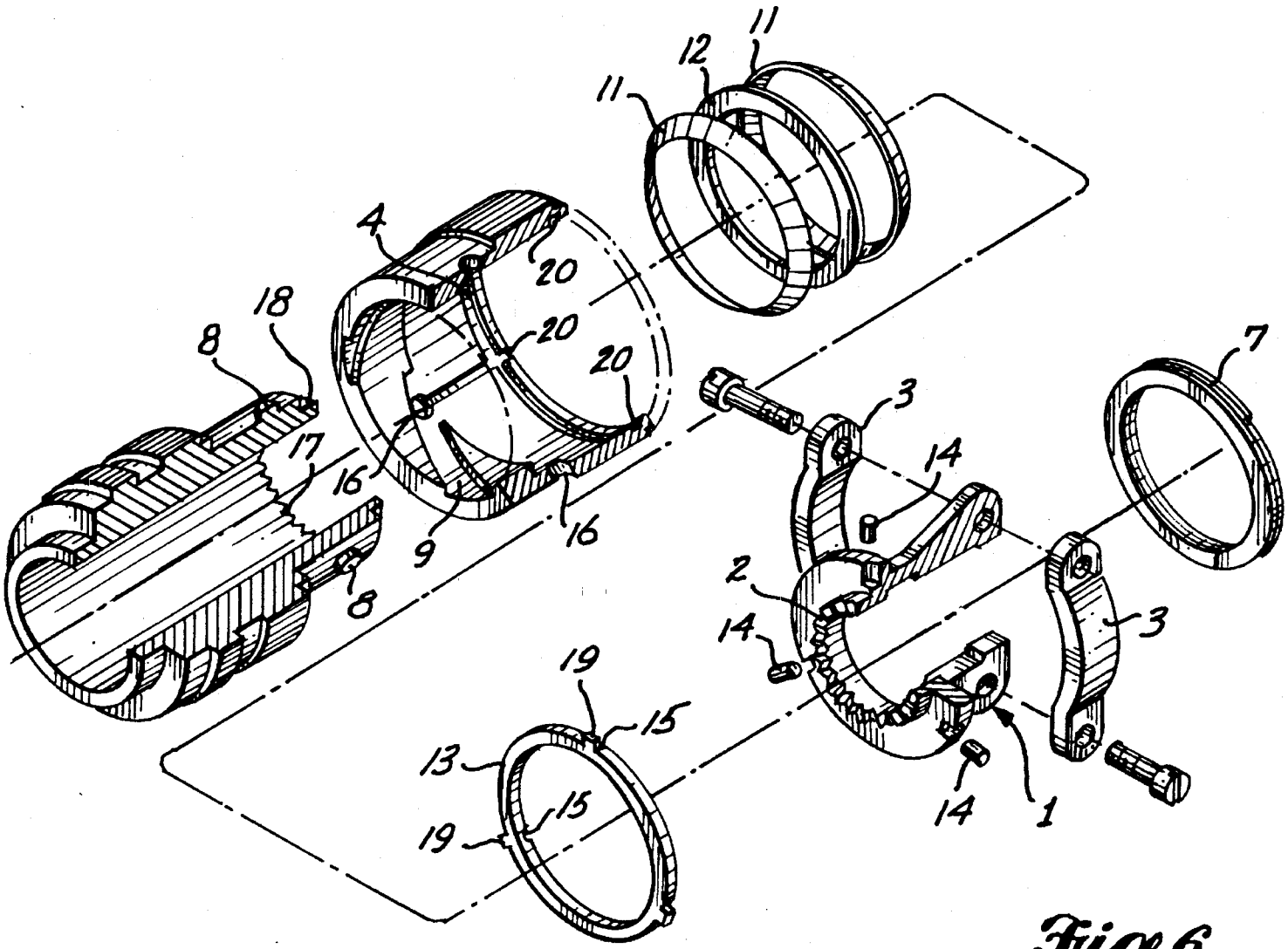
FIG. 6 is an exploded view of FIG. 5 which shows the connector bayonet pins 8 and components parts of a saddle-type cable clamp, such as: coupling ring 4 with helical ramp grooves 9 formed in the interior of the ring 4, MMB 5 accessories consisting of deflectable preloaded spring washers 11 positioned on each side of a flat washer 12, detent ring 13 with detent pockets 15 in a spaced relationship array with the detent pins 14, and grounding spring 19 centrally located in the clamp body 1. Also shown are saddle bars 3 used for wire bundle strain relief and a retaining ring 7 to connect clamp body 1 to coupling ring 4.

The invention relates to a bayonet coupling cable clamp to be used on electrical connectors as strain relief for wire bundle. The present embodiment describes two types of cable clamp, Single Leg (FIG. 2) and Saddle (FIG. 6). As is conventional, cable clamp of this type include two basic components, such as clamp body 1 with locking accessory teeth 2 and saddle bars 3 and coupling ring 4 having a plurality of helical ramp grooves 9 formed in the interior of the coupling ring 4. FIGS. 3 and 8 illustrate a full groove 9 with one bayonet pin 8 extending into each ramp groove 9, and also depicted are locking holes 10 (Single Leg) and 16 (Saddle).

The coupling mechanism on a Single Leg Cable Clamp (FIGS. 1 through 4) is accomplished when the preloaded wavespring 6 is compressed to its designed spring forces under the influence of the bayonet pins 8 reaching the closed ends of their respective helical ramp grooves 9 and pins 8 nesting in the detent holes 10 on the coupling ring 4, as illustrated in FIG. 3. In other words, the camming performed by one side of each helical groove 9 simply acts against the bayonet pins 8 to pull the cable clamp into its mating relationship with the connector. By correlating the point of compression of the wavespring 6 with the approach of the bayonet pins 8 towards the end of their respective grooves 9, the slope of the ramp grooves 9 is designed to realize the maximum mechanical advantage, thereby minimizing the amount of manual effect required to rotate the coupling ring 4.

When uncoupling the present embodiment Single Leg Cable Clamp, a reverse rotation of predetermined force on the coupling ring 4 move the bayonet pins 8 out of the detent holes 10. Once out of the detent holes 10, the wavespring 6 starts to expand to its normal working height or preloaded state, allowing complete uncoupling of cable clamp.

Figure 9:
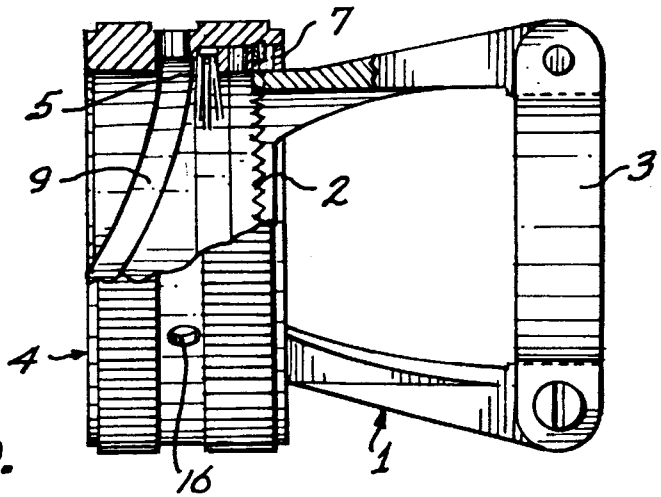
FIG. 9 is a cross-sectional isometric view of a saddle-type cable clamp.
Figure 5:
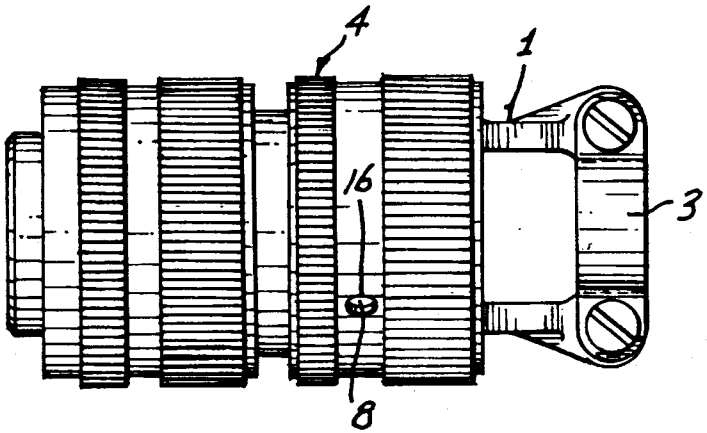
FIG. 5 is a side elevation of a saddle-type cable clamp coupled to an electrical connector. Coupling means in accordance with the preferred embodiment bayonet method whereby metal-to-metal bottoming (MMB) arrangement 5 (see FIG. 7) is accomplished; bayonet pins 8 positioned inside coupling ring holes 16 ensures occurrence of MMB 5 condition.

The present embodiment Saddle Type Cable Clamp (FIGS. 5 through 9) utilize a metal-to-metal bottoming (MMB) 5 coupling mechanism to withstand the unpressurized/high vibration areas of the airplane. MMB 5 exist when the helical ramp grooves 9 formed in the interior of the embodiment coupling ring 4 act against bayonet pins 8 mounted on an electrical connector to effect coupling between the two components. A specially tapered spring washer 11 becomes effective during the coupling procedure to maintain a no motion condition of the two components after fully mated. To achieve maximum MMB 5, the spring washer 11 thickness, diameter, shape and material are optimized to establish spring washer 11 deformation force and working range or height. In this regard, it is to be observed that the spring washer 11, which is annular, has a thicker outside diameter and a thinner inside diameter. Furthermore, the inner periphery of the spring washer 11 is offset to the left or right (dependent on the washers 11 positioning during component assembly), as can be seen in FIG. 9, for maximum MMB 5.

Describing now the components, as shown on FIG. 6, the right end of the coupling ring 4 is formed with grooves 24. Secured within the end of the coupling ring 4 by means of the grooves 24 are the two specially tapered spring washers 11 and a flat washer 12 positioned in between the two spring washers 11. Note the positioning of the two spring washers 11 to achieve maximum MMB 5 which can be seen clearly on FIGS. 7 and 9, whereby the inner spring washer 11 inner periphery is offset to the right while the outer spring washer 11 inner periphery is offset to the left. The detent right 13 engages the outer spring washer 11 and it can be pointed out the detent ring 13 having an outer key 22 spaced uniformly and integrally formed thereon which projects radially into an equally spaced longitudinally directed keyways 23 formed in the interior of the coupling ring 4. Three equally spaced detent pins 14 are angularly housed around the face 25 of the clamp body 1. A plurality of detent pockets 15 corresponding to the number of pins 14 are angularly disposed around the ring 13. The function of the detent ring 13 is to coact with the detent pins 14. Stated somewhat differently, the keyways 23 in the coupling ring 4 are selectively located so that the detent ring 13 can be angularly oriented so that the detent pockets 15 will be in alignment with the detent pins 14 each time the present invention cable clamp is coupled to an electrical connector. However, the detent pockets 15 are of smaller diameter than the detent pins 14 so that the pins 14 cannot be fully received therein. Coupling of the present invention cable clamp to an electrical connector will cause shifting of the detent pins 14 but is such as to only cause segmental portions thereof to be received in the detent pockets 15, as evidence during the later description on uncoupling the present invention cable clamp from an electrical connector.

Furthermore, as can be understood from FIG. 8, it is only when the bayonet pins 8 approach the closed ends of their respective helical ramp grooves 9 that the spring washers 11 are compressed or deflected front its preloaded state of deformation. Note that up to this point the bayonet pins 8, one is only appearing in the drawing, is represented as a dotted position in FIG. 8, there is little resistance to the mating or coupling action. In other words, the camming performed by one side of each helical grooves 9 simply acts against the bayonet pins 8 to pull the present invention cable clamp into its mating relationship with the electrical connector. By correlating the point of compression of the spring washers 11 with the approach of the bayonet pins 8 towards the end of their respective grooves 9, the slope of the helical ramp grooves 9 is lessened to realize the maximum mechanical advantage. Stated somewhat differently, the spring washers 11 requires only a few thousanths (typically <0.0008 inch) of compression or flattening in order to become effective and this need only be obtained near the ends of the grooves 9 where the slope is deliberately decreased, thereby minimizing the amount of manual effort to rotate the coupling ring 4 under these terminating conditions.

Additionally, a grounding spring 19 made of conductive material such as beryllium copper or nickel alloy is centrally positioned around the clamp body internal diameter 20. This grounding spring 11 provide interengageable contact between present invention cable clamp and electrical connector shell 21, specifically, at connector end face 18 (can be described as the area of the electrical connector shell between the first coupling thread start and valley of the locking accessory teeth) during coupling of the two components. Although the function thereof is not readily apparent at this stage of the description, it can be pointed out the grounding spring 19 is deflectable under load resulting to a resistive condition between present invention cable clamp and electrical connector. This attribute provide low impedance characteristic to the present invention bayonet coupling cable clamp or a non-bayonet style cable clamp. Also, grounding spring 19 under load acts as a mechanical washer contributing significantly to the maintenance of the coupled condition between present invention cable clamp and electrical connector.

Figure 7:
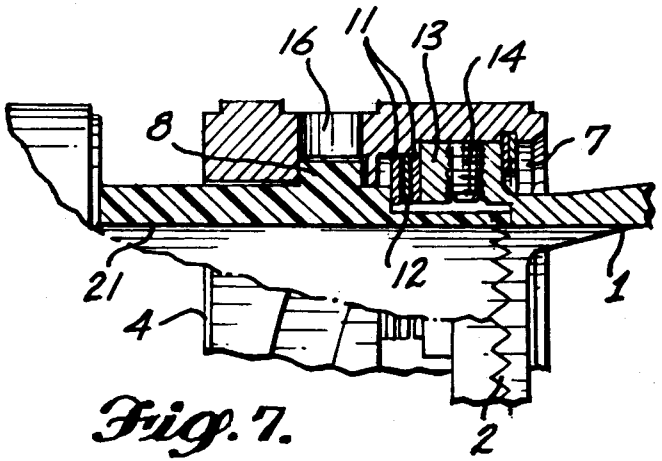
FIG. 7 is a sectional isometric view of FIG. 5 whereby the MMB 5 accessories are in the engage (fully coupled) position.

Recapitulating, the bayonet coupling of the present embodiment Saddle Type Cable Clamp occurs when desired compression or deflection on the spring washers 11 are achieved under the influence of the detent pins 14 being retentively and partially received in the detent pockets 15 on the detent ring 13, as illustrated in FIG. 7. Also, engagement of the accessory teeth on the cable clamp and connector further contribute to the maintenance of the coupled condition between the cable clamp and electrical connector. Note that the grounding spring 19, as illustrated in FIG. 7, is under compression from the connector shell 21. This added interengageable contact between cable clamp and connector significantly improved the electrical interface and lack of relative movement between the components.

When uncoupling the Saddle Type Cable Clamp, a reverse rotation of the coupling ring 4 move the detent ring 13 so as to force the partially received detent pins 14 out of the detent pocket 15. However, until the desired uncoupling force is applied to the coupling ring 4, the detent pins 14, owing to the interfering relationship they have, further assist in the unwanted separation of the cable clamp and connector. Once out of the pocket 15, the pins 14 simply roll against the face of the ring 13 in a reverse fashion from that in which they roll when the coupling is being affected. At this point, the spring washers 11 expand to their normal working height.

What is claimed is:

1. A cable clamp for an electrical connector having locking accessory teeth (2) and a grounding spring (19) as interengageable contact means;

coupling means for providing movement advancing said contact means to produce engagement;

spring washer means interposed between a portion of said coupling means, said spring washer means having a tapered cross section that is progressively deflected, reaching a desired state of compression near the end of the said coupling means for providing movement;

said coupling means includes a rotatable coupling ring (4) having angularly spaced helical ramp grooves (9) formed in the interior of said ring (4);

said grooves (9) configured to provide the maximum mechanical advantage when engaging or receiving bayonet pins (8) mounted on an electrical connector fixedly positioned in a spaced relationship with said grooves (9) during coupling of said cable clamp to said electrical connector.

2. A cable clamp for an electrical connector having locking accessory teeth (2) and a grounding spring (19) as interengageable contact means;

coupling means for providing movement advancing said contact means to produce engagement, said coupling means is rotatable, a detent ring (13) rotatable with said coupling means having axially directed pockets (15) thereon, and angularly spaced pins (14) shiftable partially into said pockets (15) when said cable clamp is in coupling condition.

spring washer means interposed between a portion of said coupling means, said spring washer means having a tapered cross section that is progressively deflected, reaching a desired state of compression near the end of the said coupling means for providing movement;

said detent ring (13) having an outer key (22) formed thereon projecting radially into a longitudinally directed keyway (23) formed in the interior of said coupling ring (4) and fixedly secured within said ring (4) to preload said spring washers (11).

3. A cable clamp for an electrical connector comprising first and second components having a locking accessory teeth (2) and a grounding spring (19) as interengageable contact means, coupling means for advancing said contact means to produce engagement;

a rotatable coupling ring (9) for advancing the first component which includes clamp body (1) having grounding spring (19) and a plurality of detent pins (14) angularly disposed around the periphery of said clamp body (1), said second component comprising detent ring (13) with detent pockets (15) in a spaced relationship array with said detent pins (14) and including spring washer means consisting of two preloaded tapered spring washers (11) fixedly positioned on each side of a flat washer (12), and, said spring washer (11) confronted by said ring (13) on one side and said washer (11) equally deflected against an electrical connector end face (18);

comprising first and second components, each having interengageable contact means;

said coupling means for providing movement advancing said first components with respect to said second component to cause a portion of said first component to abut a portion of said second component and to cause engagement of said respective contact means;

said spring washer means interposed between a portion of said coupling means and another portion of said first component, said spring means deflected by a decrease in the distance between portion of said first component and said second component; and, said spring washer means being preloaded and having a tapered cross section that is progressively deflected, reaching a desired state of compression near the end of the said coupling means for providing movement.

4. A cable clamp, as defined in claim 3, in which spring washers (11) have a thicker outside diameter and a thinner inside diameter.

5. A cable clamp, as defined in claim 3, in which said spring washer means constitutes an annular washer having a thicker outer diameter and a thinner inside diameter.

6. A cable clamp, as defined in claim 5, including detent means for assisting said annular spring washers (11) in retention of said components in their coupled relationship.

7. A cable clamp, as defined in claim 6, including detent means includes a pin shiftable into a retentive position.

8. A cable clamp for an electrical connector having locking accessory teeth (2) as interengageable contact means;

coupling means for providing movement advancing said contact means to produce engagement;

wavespring washer means interposed between a portion of said coupling means which said wavespring washer means having uniformly positioned surface projections that is progressively deflected, reaching a desired state of compression near the end of the said coupling means for providing movement;

said coupling means includes a rotatable coupling ring (4) having angularly spaced helical ramp grooves (9) formed in the interior of said ring (4); and, said grooves (9) configured to provide maximum mechanical advantage when engaging or receiving bayonet pins (8) mounted on an electrical connector which are fixedly positioned in a spaced relationship with said grooves (9) during coupling of said cable clamp to said electrical connector.

9. A cable clamp for an electrical connector having locking accessory teeth (2) as interengageable contact means;

coupling means for providing movement advancing said contact means to produce engagement;

wavespring washer means interposed between a portion of said coupling means which said wavespring washer means having uniformly positioned surface projections that is progressively deflected, reaching a desired state of compression near the end of the said coupling means for providing movement;

said coupling means includes a rotatable coupling ring (4) having angularly spaced helical ramp grooves (9) formed in the interior of said ring (4); and, said grooves (9) configured to provide maximum mechanical advantage when engaging or receiving bayonet pins (8) mounted on an electrical connector which are fixedly positioned in a spaced relationship with said grooves (9) during coupling of said cable clamp to said electrical connector;

said coupling ring (4) having detent holes (10) at the end of said ramp grooves (9) and in angularly spaced relationship with said bayonet pins (8) on said connector; and, said holes (10) assisting and maintaining said wavespring washer (6) in the retention of said components in their coupled relationship.

10. A cable clamp for an electrical connector having locking accessory teeth (2) as interengageable contact means;

coupling means for providing movement advancing said contact means to produce engagement;

wavespring washer means interposed between a portion of said coupling means which said wavespring washer means having uniformly positioned surface projections that is progressively deflected, reaching a desired state of compression near the end of the said coupling means for providing movement;

said coupling means includes a rotatable coupling ring (4) having angularly spaced helical ramp grooves (9) formed in the interior of said ring (4); and, said grooves (9) configured to provide maximum mechanical advantage when engaging or receiving bayonet pins (8) mounted on an electrical connector which are fixedly positioned in a spaced relationship with said grooves (9) during coupling of said cable clamp to said electrical connector;

said coupling ring (4) having detent holes (10) at the end of said ramp grooves (9) and in angularly spaced relationship with said bayonet pins (8) on said connector; and, said holes (10) assisting and maintaining said wavespring washer (6) in the retention of said components in their coupled relationship;

said detent means includes said detent holes (10) shiftable in a retentive position.

* * * * *